United States Patent [19]

Tanaka et al.

[11] 4,117,675

[45] Oct. 3, 1978

[54] EXHAUST PURIFYING SYSTEM FOR INTERNAL COMBUSTION ENGINES

[75] Inventors: Minoru Tanaka, Choufu; Ikuo Kajitani, Niiza; Hidenobu Nagase, Wako, all of Japan

[73] Assignee: Honda Giken Kogyo Kabushiki Kaisha, Tokyo, Japan

[21] Appl. No.: 712,346

[22] Filed: Aug. 6, 1976

[30] Foreign Application Priority Data

Aug. 11, 1975 [JP] Japan ..... 50-96662

[51] Int. Cl.[2] ..... F01N 3/15

[52] U.S. Cl. ..... 60/302

[58] Field of Search ..... 60/274, 282, 322, 302, 60/323, 301

[56] References Cited

U.S. PATENT DOCUMENTS

| | | | |
|---|---|---|---|
| 3,577,727 | 5/1971 | Warren | 60/282 |
| 3,823,555 | 7/1974 | Cole | 60/301 |
| 3,881,316 | 5/1975 | Bunda | 60/302 |
| 3,911,676 | 10/1975 | Jensen | 60/302 |
| 3,927,525 | 12/1975 | Jacobs | 60/302 |
| 3,965,881 | 6/1976 | Sakurai | 60/282 |
| 3,968,645 | 7/1976 | Noguchi | 60/302 |
| 3,968,648 | 7/1976 | Futamura | 60/282 |

*Primary Examiner*—Douglas Hart
*Attorney, Agent, or Firm*—Lyon & Lyon

[57] ABSTRACT

An exhaust purifying system for a multi-cylinder four-cycle internal combustion engine operating on an intake mixture leaner than stoichiometric employs first preliminary reaction chambers receiving exhaust gases from ports connected to cylinders having successive firing order. The exhaust gases are then delivered from said first preliminary reaction chambers to a single second preliminary reaction chamber and then to a catalytic reaction chamber containing oxidative catalysts of base metals, and then finally to an oxidative reaction chamber. The intake mixture for the engine is heated from exhaust gases in the oxidative reaction chamber. This particular succession of chambers causes the temperature of the exhaust gases to increase to above 800° C.

1 Claim, 4 Drawing Figures

EXHAUST PURIFYING SYSTEM FOR INTERNAL COMBUSTION ENGINES

This invention relates to exhaust purifying systems for multi-cylinder internal combustion engines. The invention is particularly directed to an exhaust purifying system for a four-cycle gasoline-powered internal combustion engine of multi-cylinder type using a relatively lean mixture. Such engines are often used in automobiles.

Usually, in engines of this kind the relation between the air-fuel ratio of the mixture used, and emissions of harmful components in the exhaust is as shown in FIG. 1. It is known that whether the air-fuel ratio is set on the rich side or on the lean side of the stoichiometric air-fuel ratio, shown by point "A", NOx is reduced. However, when consideration is given to the increase of CO and HC, the setting on the lean side is advantageous as compared with the setting on the rich side. Furthermore, when consideration is given to after-treatment to reduce HC and CO in the exhaust, the setting of the air-fuel ratio on the rich side as compared with the setting on the lean side is disadvantageous for several reasons including the requirement of supplying secondary air. Thus, it is commonly known that the setting on the lean side is advantageous, in which case if the air-fuel ratio is set, for instance, at point "B" or closer to the combustible limit in FIG. 1, the peak temperature during combustion and therefore the temperature of the exhaust gas lowers remarkably, resulting in an inevitable worsening in fuel consumption. Then, to improve this, the ignition timing of the engine is advanced and the generation of NOx increases, so that the air-fuel ratio must be corrected further onto the lean side. These adjustments may be chosen so as to control the generation of NOx to a specified level. However, according to this method, the peak temperature during combustion and therefore the temperature of the exhaust gas are further lowered, making it impossible to obtain the necessary reaction for minimizing HC and CO in a normal oxidative reaction chamber. The temperature of the exhaust gas should be at least at approximately 800° C., for this reaction. Therefore, the temperature of the exhaust gas is required to be raised prior to its being introduced into the oxidative reaction chamber.

Now, on the other hand, it has been found that HC in the exhaust gas is oxidized to increase the amount of CO in the range of temperatures lower than 800° C. and its reaction produces a temperature rise, and that when the exhaust gas thus raised in temperature is then made to act on oxidation catalysts of base metals, CO in said gas is changed highly efficiently into $CO_2$, meanwhile by its reaction the temperature of said gas is further raised.

This invention is characterized by the fact that in an internal combustion engine of the multi-cylinder type having at least two cylinders and using a relatively lean mixture, the exhaust gases after being discharged from each exhaust port of said two cylinders are caused to meet each other in a preliminary reaction chamber immediately behind each outlet for reaction. The exhaust gases are then successively introduced into a catalytic reaction chamber using oxidative catalysts of base metals, and immediately behind said preliminary reaction chamber. The gases then pass into an oxidative reaction chamber immediately behind said catalytic reaction chamber.

Furthermore, a second feature of this invention is characterized by the fact that in such system, the internal combustion engine has at least four cylinders, two that are successive in firing order and the other two that are successive in firing order. The exhaust from each of the first two cylinders and the exhaust from the other two cylinders are caused to meet each other in first preliminary reaction chambers immediately behind each outlet, respectively. These exhausts are then made to meet each other in a next stage in a combined preliminary reaction chamber immediately behind said first preliminary reaction chambers, and the resultant exhaust is then introduced successively into a catalytic reaction chamber and then into an oxidative reaction chamber.

Furthermore, a third feature of this invention is characterized by the fact that it provides in a middle part of said oxidative reaction chamber an intake heating section to heat an intake passage of the engine. Also, a fourth feature of this invention is characterized by the fact that it forms an exhaust manifold extending from the side of said internal combustion engine with an outer shell and an inner liner insulated thermally therefrom. Housed in said inner liner is a catalytic reaction chamber with a space around its periphery, the space being made to operate as an oxidative reaction chamber. Furthermore, the upstream side of said inner liner is formed to provide a preliminary reaction chamber.

Figure 1:
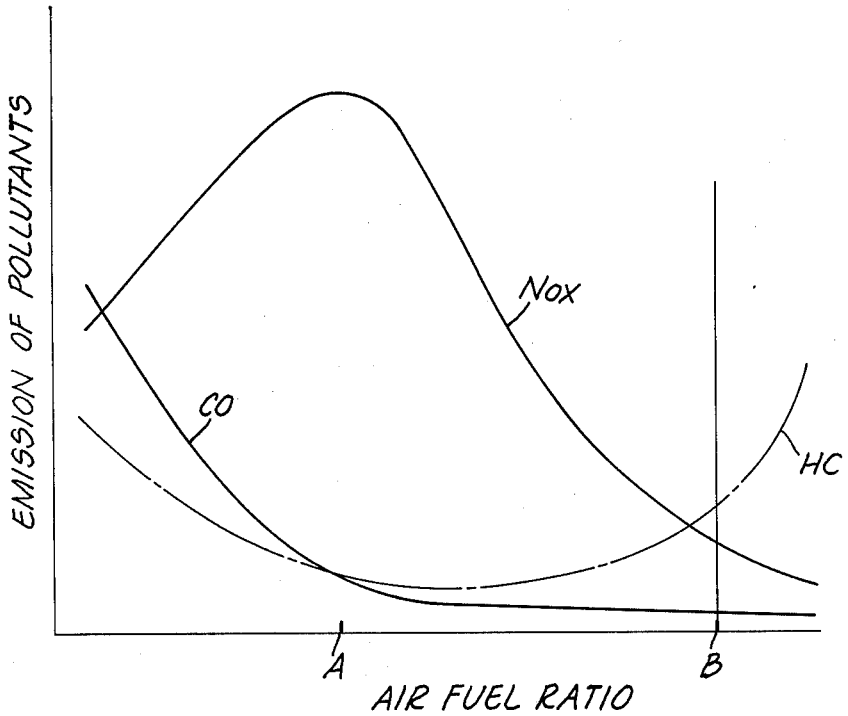
FIG. 1 is a diagram showing the relationship between the air-fuel ratio of the intake gases and the quantity of emission of pollutants NOx, CO and HC in the exhaust gases.

Referring to the drawings, the four-cycle internal combustion engine generally designated 1 has four cylinders *2a, 2b, 2c* and *2d*. The cylinders *2a* and *2b* have successive firing order, and the cylinders *2c* and *2d* have successive firing order. The exhaust ports *3a* and *3b* are parallel and adjacent to each other, and the exhaust ports *3c* and *3d* are parallel and adjacent to each other. Each has a piston 4 and an exhaust valve 5.

At one side of the engine 1 and connected thereto are provided an exhaust manifold generally designated 6 and an intake manifold generally designated 7. The intake manifold 7 rests on the exhaust manifold 6 so as to form a riser section 8. The intake mixture supplied to the engine 1 through the intake manifold 7 is heated in the riser section 8 by the exhaust gases in the exhaust manifold 6. The mixture is leaner than stoichiometric, so lean, for example, as to be represented by point "B" in FIG. 1, or even closer to the combustible limit. The exhaust manifold 6 comprises an outer shell *6a* of relatively thick walls, and an inner or second liner *6b* of relatively thin walls, insulated thermally therefrom by an insulating layer 6C. On the upstream side of the second liner is provided a pair of preliminary reaction chambers *9a* and *9b*, right and left defined by enlargements in the ends of an induction pipe extending between pairs of exhaust ports. The exhausts from said each pair of exhaust ports *3a, 3b* and *3c, 3d* are caused to meet each other immediately behind each outlet for reaction, respectively. The second liner 6b provides a next stage preliminary reaction chamber 10 where the exhausts from said both reaction chambers 9a and 9b are caused to meet each other in an oppositely directed facing manner at an outlet opening intermediate the ends of the induction pipe. Furthermore, within the liner 6b is provided a first liner defining catalytic reaction chamber 11 containing oxidative catalysts of base metals, such as Cu-Ni alloy, Cu-Ni-Cr alloy, Cu-Ni-Co alloy, etc. The catalytic reaction chamber 11 is housed in said second liner 6b approximately at the middle thereof with a space around its periphery; the space being made to operate as an oxidative reaction chamber 12 connected by discharge opening 11a to the downstream side of said reaction chamber 11. A portion of the oxidative reaction chamber 12 faces the underside of said intake manifold 7, so that it operates as a riser 8, that is, an intake heating section.

Figure 4:
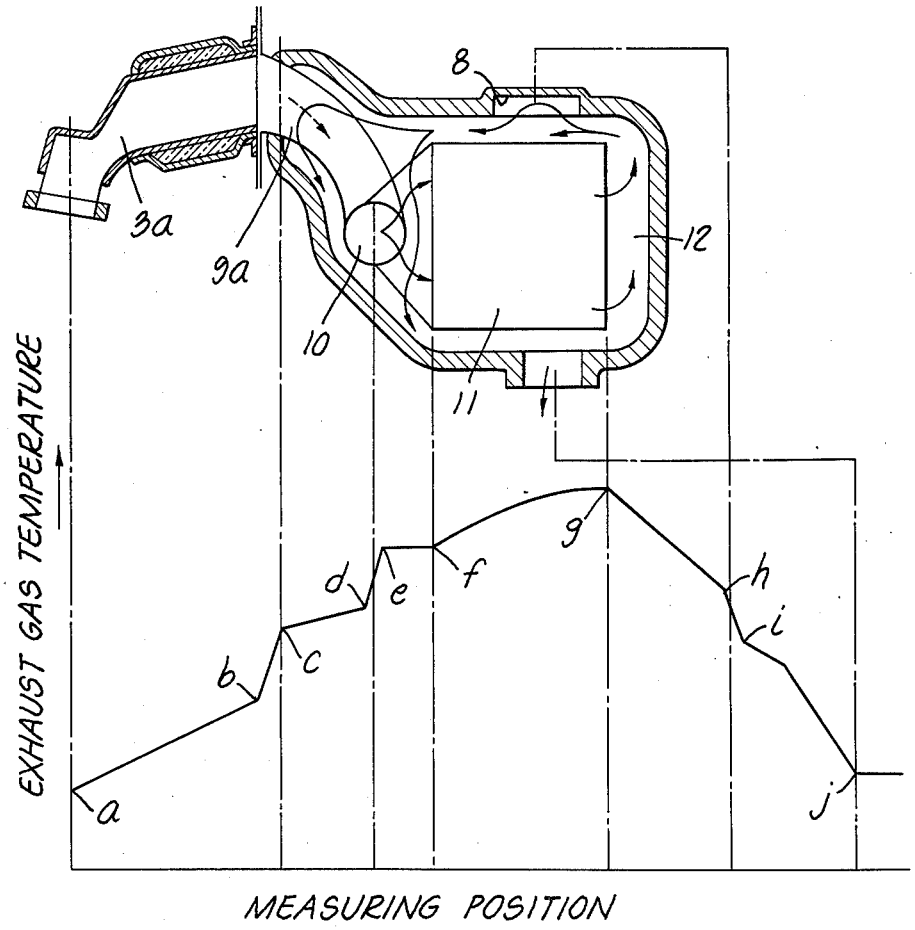
FIG. 4 is a diagram showing exhaust gas temperatures at various locations in the exhaust system of the method and apparatus embodying this invention.
Figure 2:
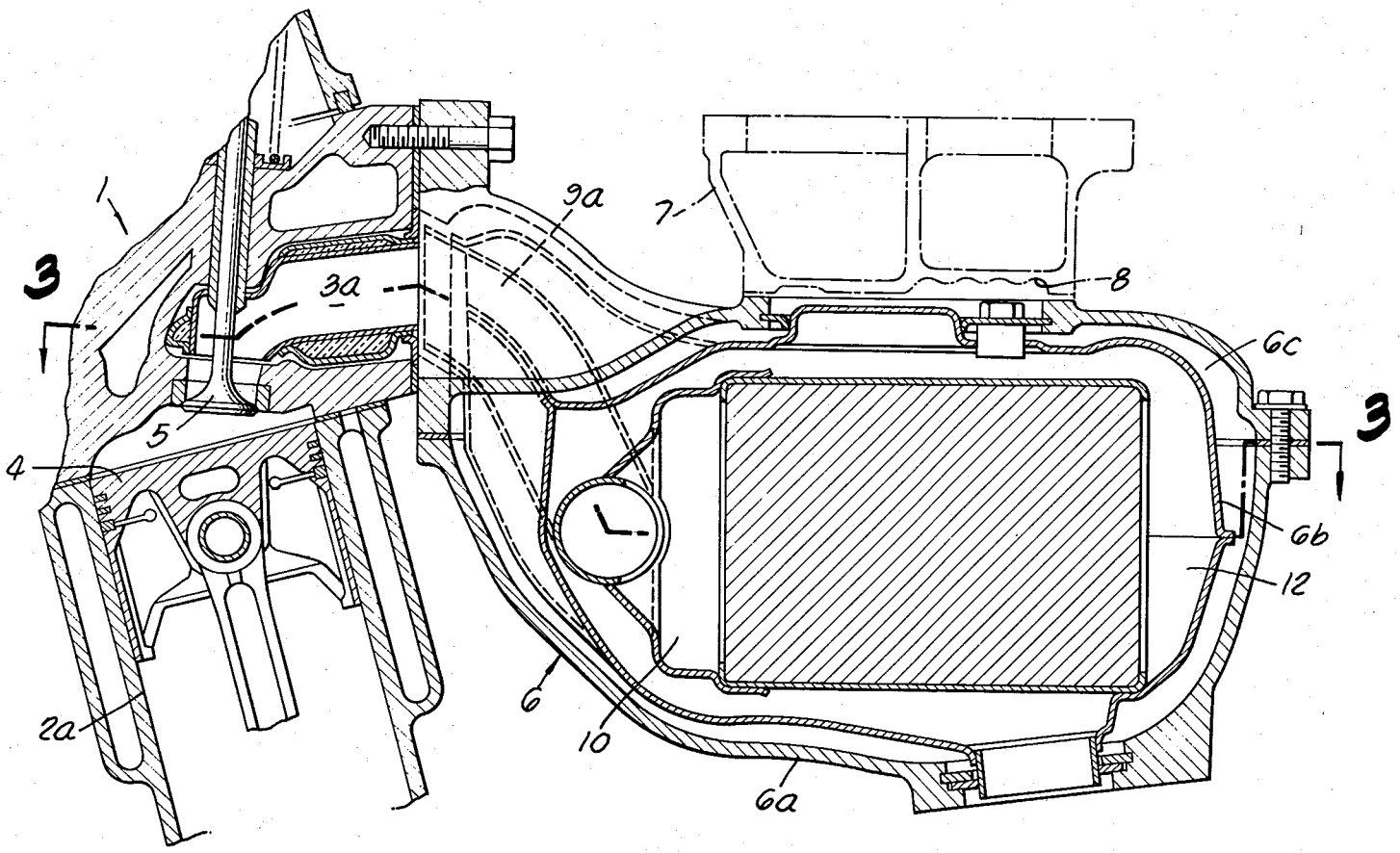
FIG. 2 is a sectional side elevation taken substantially on the lines 2—2 as shown in FIG. 3 showing a preferred embodiment of the apparatus of this invention.
Figure 3:
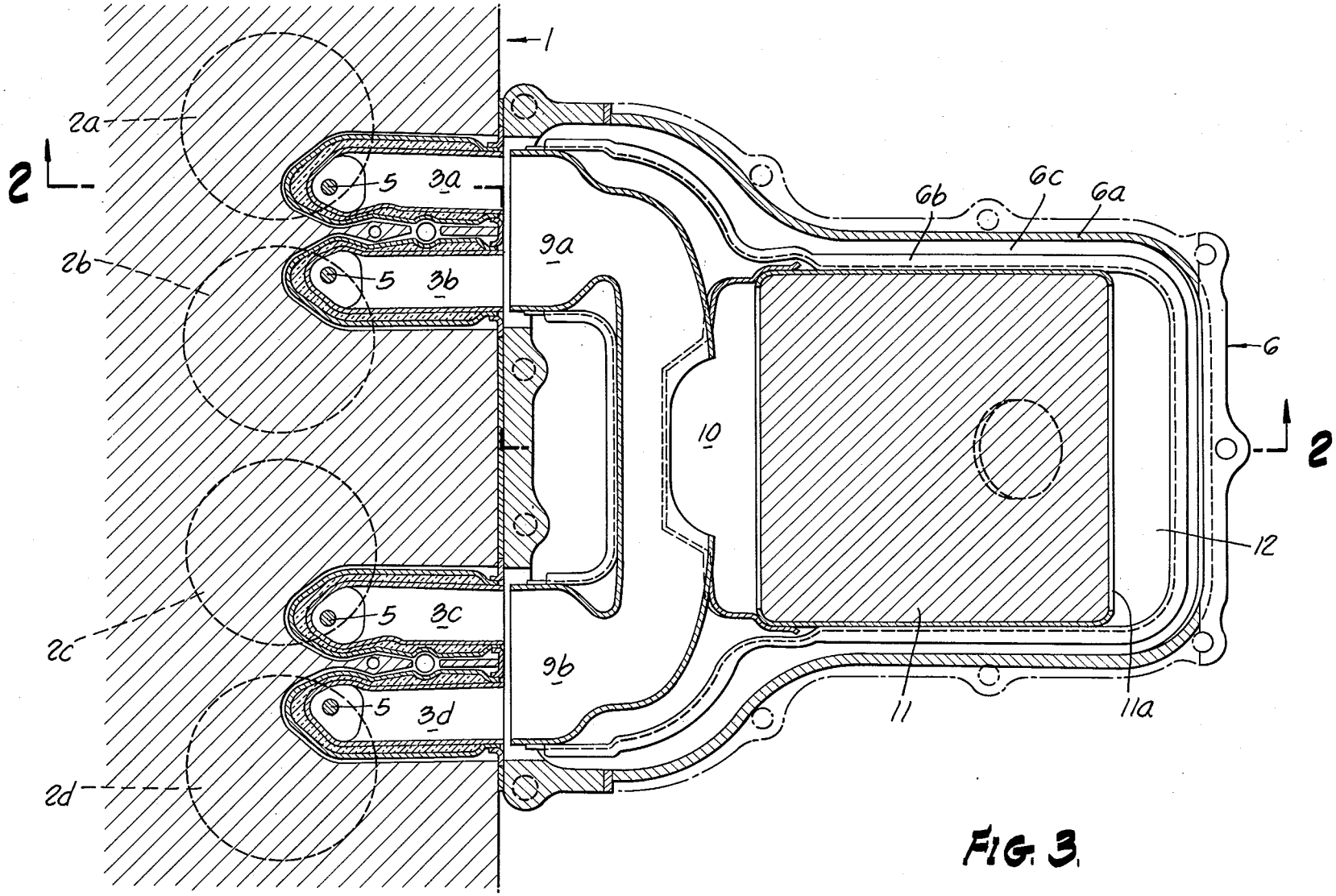
FIG. 3 is a sectional plan view taken substantially on the lines 3—3 as shown in FIG. 2.

In operation, the combustion temperature in each cylinder 2 is low, and the exhaust gas discharged from each exhaust port 3a, 3b, 3c, 3d is therefore at relatively low temperature. The exhaust gases discharged from each adjacent pair of exhaust ports are caused to meet each other in each preliminary reaction chamber 9a and 9b for reaction. Since this reaction takes place in the range of relatively low temperatures, the reaction that takes place is one where, as described before, mainly HC is oxidized to increase the amount of CO; in keeping with this, the exhaust gas is reduced in HC, while its temperature rises. As shown in FIG. 4, the temperature rises from point "*a*" to point "*b*" in each exhaust port, then to point "*c*" in each preliminary reaction chamber 9a, 9b. Then, the exhaust gases in both reaction chambers 9a, 9b flow directly into the preliminary reaction chamber 10 of the next stage, and join each other for reaction. Similarly, the principal reaction is further oxidation of HC to increase the amount of CO. In keeping with this reaction, the temperature of the exhaust gases rises from point "*d*" to point "*e*", and in this condition it flows into the catalytic reaction chamber 11 of the next stage, through the entrance opening shown where the action is mainly of changing CO into $CO_2$. Thus, by this reaction the temperature of the exhaust gases rises further from point "*f*" to point "*g*", and then the exhaust gases are introduced into the oxidative reaction chamber 12 of the next stage. By this time, as a result of the temperature rise in each reaction, the exhaust gas temperature increases to approximately 800° C., so that it performs normal oxidative reaction in said chamber 12 to remove most of the remaining HC and CO. The exhaust gases then perform the intake mixture heating in the riser section 8, and consequently the temperature lowers from point "*h*" to point "*i*". The temperature continues to lower further as the exhaust gases are discharged into an exhaust pipe at "*j*".

As is seen from the foregoing, the present invention has important advantages for use in engines of the type setting the intake mixture on the lean side close to the combustible limit. Exhaust gases of relatively low temperature in each cylinder are caused to meet each other in the preliminary reaction chambers to perform the preliminary reaction of mainly oxidizing HC to increase the quantity of CO, thereby raising the exhaust gas temperature. The exhaust gases are then introduced into the catalytic reaction chamber to perform the catalytic reaction of mainly changing CO into $CO_2$, thereby obtaining a temperature rise. The exhaust gases thus raised to a required temperature by the previous temperature rises are then introduced into the oxidative reaction chamber to perform the oxidative reaction. By such process, the invention provides excellent exhaust purification and stable operation over a long period of time without requiring any supply of secondary air and temperature control of the catalytic reaction chamber. Furthermore, in accordance with a second feature of the invention such process can be achieved more effectively in the case of a four-cylinder engine by adding another preliminary reaction chamber. Moreover, in accordance with a third feature of the invention, intake mixture heating can be performed effectively without giving any disadvantage to the exhaust purifying process in particular. Also, in accordance with a fourth feature of the invention, all the reaction chambers can be housed in the exhaust manifold in an insulated and compact manner.

Having fully described our invention, it is to be understood that we are not to be limited to the details herein set forth but that our invention is of the full scope of the appended claims.

We claim:

1. Apparatus for purifying the exhaust gases from a multi-cylinder internal combustion engine operating on an intake mixture leaner than stoichiometric, the engine having multiple pairs of adjacent exhaust ports of successive firing order, comprising:

an exhaust manifold comprising an induction pipe extending from one pair of exhaust ports to an adjacent pair and having enlarged end portions each arranged to receive exhaust gases directly from a pair of adjacent exhaust ports, said enlarged end portions defining first preliminary reaction chambers;

said induction pipe having an outlet opening between its ends;

means forming a second reaction chamber communicating with said outlet opening;

a first liner forming a catalytic reaction chamber having an entrance opening communicating with said second reaction chamber and containing oxidative catalysts of base metals, and a discharge opening;

a second liner of relatively thin walls, enclosing and spaced from said induction pipe, said second reaction chamber and said first liner and defining an oxidative chamber in communication with said discharge opening, said oxidative chamber communicating with an exhaust pipe; and an outer shell of relatively thick walls enclosing and spaced from said second liner.

* * * * *